US006796160B2

(12) United States Patent
Ouimet

(10) Patent No.: US 6,796,160 B2
(45) Date of Patent: Sep. 28, 2004

(54) CUTTER/CRIMPER APPARATUS AND METHOD

(76) Inventor: Peter Ouimet, 9423 192nd St, Surrey, B.C. (CA), V4N 3R7

( * ) Notice: Subject to any disclaimer, the term of this patent is extended or adjusted under 35 U.S.C. 154(b) by 0 days.

(21) Appl. No.: 10/127,431

(22) Filed: Apr. 17, 2002

(65) Prior Publication Data

US 2003/0024294 A1 Feb. 6, 2003

Related U.S. Application Data

(60) Provisional application No. 60/284,768, filed on Apr. 18, 2001.

(51) Int. Cl.[7] ..... H01R 43/042; B21D 28/00

(52) U.S. Cl. ..... 72/416; 72/324; 72/453.16; 72/404; 29/566.4

(58) Field of Search ..... 72/416, 464, 324, 72/453.16, 453.15, 404, 409.01, 409.19; 29/237, 751, 753, 566.2, 566.4, 566.3, 565

(56) References Cited

U.S. PATENT DOCUMENTS 939,468 A * 11/1909 Boyce ..... 72/332
1,268,139 A * 6/1918 Martin ..... 72/416
3,568,496 A * 3/1971 Burke ..... 72/404
4,226,109 A * 10/1980 Nilsson ..... 72/412
4,246,771 A * 1/1981 Covill et al. ..... 72/326
4,558,584 A * 12/1985 Myers ..... 72/407
4,660,241 A * 4/1987 Chen et al. ..... 7/107
4,730,476 A * 3/1988 Lindberg et al. ..... 72/407
5,463,892 A * 11/1995 Nakagawa ..... 72/456
6,151,784 A * 11/2000 Maruyama ..... 30/134

* cited by examiner

*Primary Examiner*—Daniel C. Crane
(74) *Attorney, Agent, or Firm*—Robert B. Hughes; Hughes Law Firm, PLLC

(57) ABSTRACT

A crimping and cutting apparatus having upper and lower die members, with each die member having matching crimping surfaces and matching cutting surfaces which define a crimping region and a cutting region. A cylinder and piston assembly moves the first die member between upper and lower positions to accomplish the crimping and the cutting. The apparatus can be grasped manually, and it is particularly adapted for use in an operation where a cable is placed around a bundle of logs, and the ends of the cable are connected by crimping, and one end of the cable being cut from the cable leading to a spool.

9 Claims, 6 Drawing Sheets

CUTTER/CRIMPER APPARATUS AND METHOD

RELATED APPLICATIONS

This application claims priority benefit of U.S. Provisional Application Ser. No. 60/284,768, filed Apr. 18, 2001.

BACKGROUND OF THE INVENTION a) Field of the Invention

This invention relates to an apparatus and method of selectively crimping and/or cutting one or more elongate members, such as cables, and more particularly to a manually operated apparatus for accomplishing the crimping and/or cutting operations.

b) Background of the Invention

Cutting and crimping devices have been used in various industries to cut cable wires as well as crimp sleeves around the of two cable portions to form a loop or otherwise make a connection. One industrial application for such crimping/cutting operations is in the logging industry, and more particularly in a situation where two or more cables are placed around a group of logs to form a secured log bundle.

In a log transferring operation a bundle of logs is held in two U-shaped frames where the bottom portion of the log bundle is spaced above the floor or ground level.

There is provided a cable, possibly as long as 600 feet which is wound onto a drum. A crimping sleeve (i.e. a crimping connector) is inserted over the free end of the cable and moved down along the length of the cable. Then the free end of the cable is thrown over one end portion of the log bundle in the U-shaped frames. The free end of the cable is then pulled back under the log bundle, and then inserted into the end opening of the crimping sleeve through which it was originally inserted. Then a crimping apparatus clamps the crimping sleeve tightly against the two cable lengths within the opening of the crimping sleeve. This crimping operation is done possibly seven or eight times. After this, the cable from the coil is cut about six inches away from the end of the crimping sleeve to complete the formation of the loop around that end of the log bundle.

The same process is done on the other end portion of the log bundle. Generally two cable section loops will secure a log bundle sufficiently, although more loops can be used. When the log bundle is secured with the cable length, it is commonly ejected from the two fork frames into an adjacent body of water and the log bundle floats or is tugged through the body of water to a log separation and transport area.

There are other situations that require crimping and/or cutting of cables and the like. In some situations, the crimping and the cutting operation is accomplished as part of a single operation, where the crimping and the cutting are accomplished as a part of one operation.

SUMMARY OF THE INVENTION

The present invention is designed to accomplish both a crimping action and also a cutting action in a particularly convenient and effective manner.

This apparatus comprises a housing section, with an actuator section located in the housing. This actuator section in turn comprises an actuator that has a power section and a drive member having a drive portion for back and forth travel. There is a die assembly mounted in the housing section, and this die assembly has an operating region which comprises adjacent crimping and cutting regions. The die assembly comprises a first die member which is connected to the drive member and comprises a first crimping surface at the crimping region and a first cutting surface at the cutting region. There is also a second die member mounted to the housing and comprising a second crimping surface at the crimping region and a second cutting surface at the cutting region.

The first and second crimping surfaces and the first and second cutting surfaces are positioned opposite to one another and located so as the drive member moves the first drive member toward the operating region the first and second crimping surfaces coming into a crimping position relative to one another to be able to perform a crimping operation. Also, the first and second cutting surfaces come into a cutting position relative to one another to be able to perform a cutting operation.

The apparatus is arranged with an operating access opening connecting to the operating region. Thus, a member or members to be crimped and/or cut is able to be moved through said access opening into said operating location through either the crimping region or the cutting region to be crimped or cut, respectively. Alternatively, the member to be crimped and/or cut can be both crimped and cut in separate crimping and cutting operations while remaining in the operating region.

In a preferred form, the housing section comprises an upper housing portion and a lower housing portion aligned with one another along a longitudinal axis. The actuating section comprises a hydraulically-operated power section that comprises an outer cylindrical, vertically-aligned sidewall having upper and lower cap portions. The piston member is mounted in the cylinder for back and forth motion. The upper cap portion defines with the cylinder and the piston an upper chamber, and the lower cap portion defines with the cylinder and piston a lower chamber. A drive rod is connected to the piston and operably connected to the first die member.

In a preferred configuration, the first and second die members are positioned in the lower housing portion, and there is a guide structure comprising right and left guide portions engaging right and left portions of the upper first die member for movement back and forth in the guide portions.

The apparatus in the preferred configuration further comprises a positioning section which in a preferred from comprises one or more handles which can be grasped manually by a person to position the apparatus. Further, there is a control device mounted on at least one handle. This control device is operated to cause power to be delivered to said actuator section in a manner to cause the back and forth movement of the first die member.

Also, in the preferred configuration, the housing comprises an upper housing portion and a lower housing portion that are aligned along a longitudinal axis. The first and second die members are positioned in the lower section, and the first die member moves along a path in general alignment with the longitudinal axis.

The actuator section is arranged to move the drive portion back and forth along a drive axis, and the first crimping surface and the first cutting surface of the first die member are generally aligned with one another along a lateral axis having a substantial transverse alignment component generally perpendicular to the drive axis.

The crimping region and the cutting region are open to one another so that a member or portions of a member to be crimped and cut can be moved between said crimping and cutting regions without being removed from the operating region. Further, the access opening is spaced laterally from the operating region so that a member to be crimped and/or cut can be moved laterally into the operating region and selectively to either or both of said crimping and cutting regions. The access opening is laterally aligned with the operating region in a preferred configuration.

The housing has a longitudinal axis and the actuating section comprises a cylinder and piston assembly located in an upper housing portion, and has a drive access generally aligned with a longitudinal axis. The housing further comprises a lower housing portion at which the second die member is located, and the axis opening is located between the upper and lower housing portions and opens laterally to the operating region.

In a preferred form, the second die member is removably located in the lower housing section, so that the second die member can be removed and/or replaced.

The apparatus has a positioning section which comprises in one embodiment a handle which may be manually grasped. The handle has a first connecting portion connected to the housing and extended laterally from the longitudinal axis of the apparatus. In another configuration the positioning section comprises two handles one of which is attached to the upper housing portion and the other which is adjacent to the lower housing portion. Each of the handles are adapted to be manually grasped.

In the method of the present invention, an apparatus is provided as described above. An elongate member is placed in the operating region of the die assembly. This elongate member is located either between the first and second crimping surfaces or between the first and second cutting surfaces to accomplish either a cutting or crimping operation, respectively.

Then the drive member is operated to move the first die member toward the operating region to cause either the crimping of the elongate member or the cutting, depending upon the position of the elongate member.

The present invention also comprises a mounting assembly for the apparatus. This mounting apparatus comprises a mounting member, a laterally extending retractable and extendable support member, and a stretchable connecting member that connects the crimping and cutting apparatus to an outer extendable end of the support member.

Other features of the present invention will become apparent from the following detailed description.

BRIEF DESCRIPTION OF THE DRAWINGS

FIG. 11-A is a side elevational view of the apparatus having a modified design of a handle section;

FIG. 11-B is a view similar to FIG. 11-A but showing a further modified design of the handle section of the present invention;

DETAILED DESCRIPTION OF THE PREFERRED EMBODIMENTS a) Introduction

In the following text, there will first be a description with reference to FIGS. 1–5 of the environment in which the present invention can be advantageously used, with FIGS. 1–5 showing how bundles of logs are commonly secured with a pair of cable sections. Then there will be a more general description of the apparatus of the present invention, with reference to FIGS. 6–11, 11-A and 11-B. This will be followed by a description of the mounting apparatus of the present invention, with reference to FIGS. 12–13. Finally, there will be a more detailed description illustrating the specific configuration of the components of the apparatus of the present invention, these being shown in FIGS. 14–23.

Figure 1:
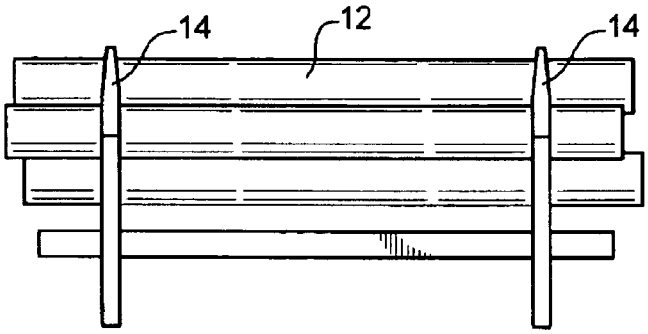
FIG. 1 is a side elevation of a view of a location with a bundle of logs in a support frame, where the present invention could be advantageously used.
Figure 2:
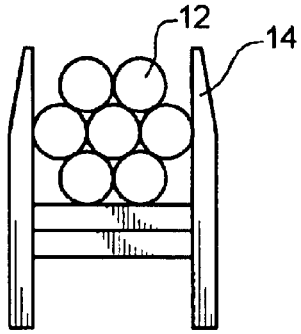
FIG. 2 is an end view of the bundle of logs as shown in FIG. 1.
Figure 3:
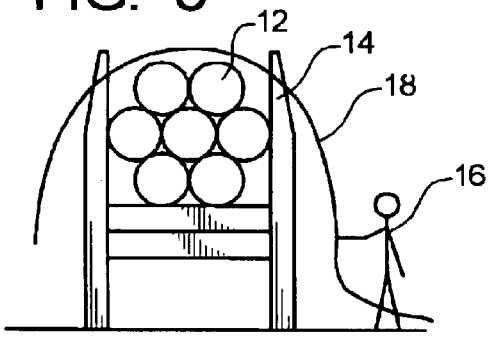
FIG. 3 is an end view similar to FIG. 2, showing an individual in the process of binding the logs where the cable has been shown over the log bundle.
Figure 4:
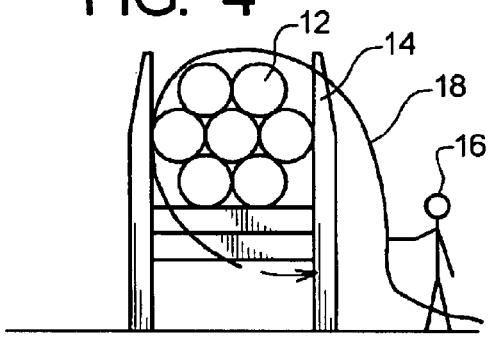
FIG. 4 is a view similar to FIG. 3, but showing one end of the cable being moved beneath the log bundle.
Figure 5:
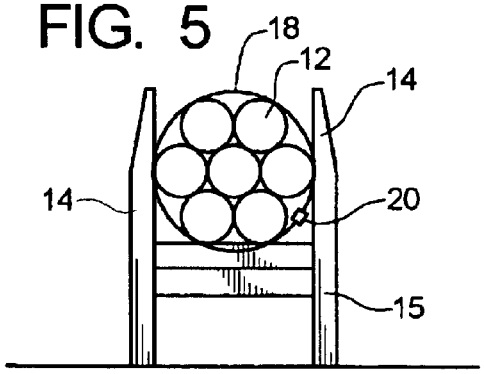
FIG. 5 is a view similar to FIG. 4, but showing the two ends of the cable locked together to form a loop around the log bundle.

As indicated previously, one environment in the logging industry where the present invention is desirably used is in a logging bundling operation where two lengths or pieces of cable and two locking devices are employed to hold the bundle of logs together. As seen in FIG. 1, the logs 12 rest in two U-shaped frames 14 of a log-contained structure 15. There is shown a worker 16 on one side of the bundle of logs 12. To secure the log bundle, the worker 16 throws the cable 18 over the log bundle, as shown in FIG. 3. The end of the cable 18 is passed under the log bundle back to the worker 16.

Then the worker 16 will pass the end of the cable back through the crimping sleeve and then go through the crimping and cutting process as described earlier in this text under the "Background of the Invention".

Figure 6:
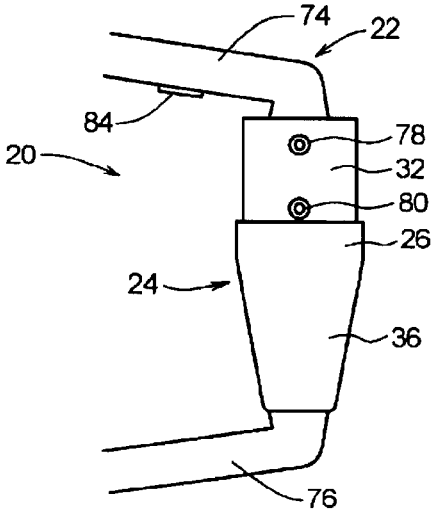
FIG. 6 is a side elevational view of the apparatus of the present invention.
Figure 7:
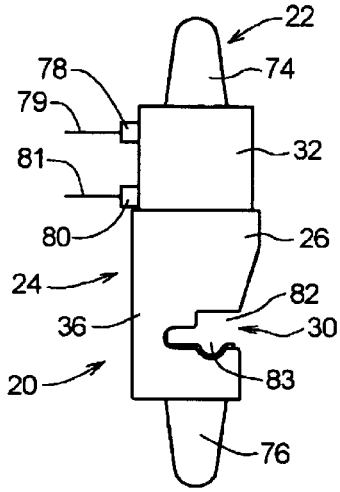
FIG. 7 is a front elevational view of the apparatus of FIG. 6.
Figure 8:
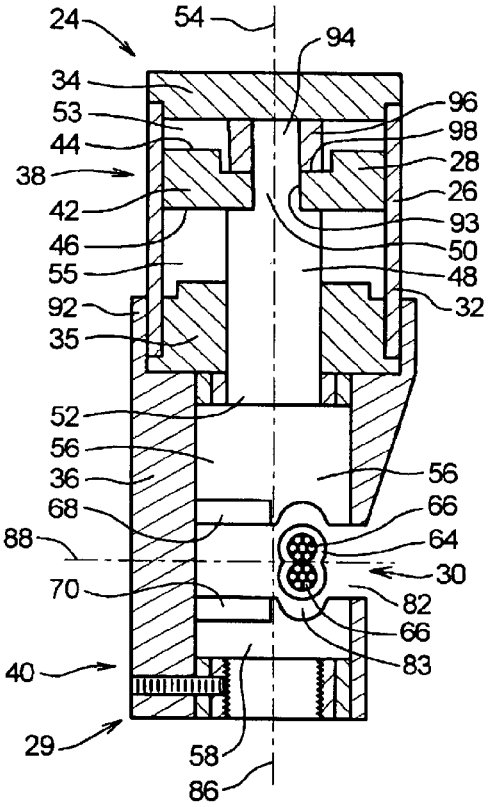
FIG. 8 is a sectional view taken along a vertical longitudinal axis of the apparatus, taken from the same location as in FIG. 7.

With reference to FIGS. 6–8, the cutter crimper 20 comprises a handle section 22, and an operations section 24. As shown in FIG. 8, the operating section 24 comprises a housing section 26 in which is positioned a drive assembly 28 and a die assembly 30. This housing section comprises an upper cylindrical sidewall 32, which is closed by an upper cap 34 and a lower cap 35, and a base region 36. Thus the housing 26 can be considered as comprising an upper housing section 38 which is made up of the cylindrical sidewall 32, the upper cap 34, the lower cap 35, and a lower housing section 40 which comprises the base region 36, which is part of an actuator section 29.

The drive assembly 28 comprises a piston 42 which has a first upper surface 44 and a second lower surface 456. The piston 42 connects to a driveshaft 48 having an upper connecting portion 50 and a lower drive portion 52.

It should be noted that the cylindrical sidewall 32, the upper cap 34, and the lower cap 35, which collectively make up the upper housing section 38, also, in this particular design, function as the cylinder for the piston 42 and the drive shaft 48. There is a first upper chamber 53 positioned between the upper cap 34 and the piston 42, and a lower chamber 55 between the piston 42 and the lower cap 35. By introducing a pressurized fluid (desirably hydraulic fluid) selectively in the upper or lower chambers 55, the piston 42 and the shaft 48 are caused to reciprocate upwardly and downwardly along a drive axis 54.

Figure 9:
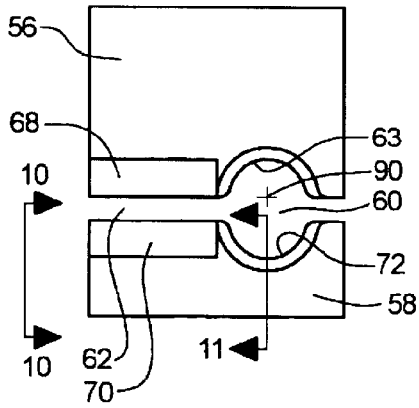
FIG. 9 is a view taken from the same location as FIGS. 7 and 8, and showing only the upper and lower die members of the apparatus.
Figure 10:
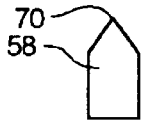
FIG. 10 is a view taken at the location of the line 10—10 as shown in FIG. 9, and showing the cutting portion of the die assembly as shown in FIG. 9.

The die assembly 30 comprises a first upper die member 56 and a second lower die member 58. The first die member 56 is attached to the drive shaft 48. As shown in FIG. 9, the upper and lower die members 56 and 58 define a crimping region 60 and a cutting region 62. At the crimping region 60 the upper die member 56 has a crimping surface 63, which in this preferred configuration is in the shape of a cylindrically semi-circular surface 63 and is arranged to engage a member to be crimped, such as the aluminum crimping sleeve 64 in which are two cable portions 66, as shown in FIG. 8.

As seen in FIG. 9, the upper die member 56 has a V-shaped cutting surface 68 at the cutting region 62, this cutting surface 68 being arranged to engage a cable and cooperate with a second V-shaped cutting surface of the lower die member 58 to cut the cable. The second die member 58 also has a cylindrically semi-circular crimping surface 72 at the crimping regions 62 that is substantially the same as the surface 63. Thus, these two crimping surfaces 63 and 72 are arranged to cooperate to apply equal and opposite pressure to the aluminum sleeve 64.

Now, referring back to FIGS. 6 and 7, the handle portion 22 comprises first and second handle members (only connecting portions of which are shown at 74 and 76) that are attached to the housing 26. The upper housing section 26 comprises inlet/outlet ports 78 and 80 connecting to the first and second chambers 53 and 55, respectively.

In operation, the first chamber 53 is pressurized via a high-pressure line (indicated schematically at 79) connected to inlet port 78 to drive the piston 42 and the driveshaft 48 downwardly. Simultaneously, the port 80 is in communication with a low-pressure line (indicated schematically at 81) to allow fluid contained within chamber 55 to be discharged therefrom. This applies pressure upon the upper surface 44 of the piston 42 and to move the drive shaft 48.

Then to raise the upper die member 56, the flow of hydraulic fluid is reversed so that fluid flows into the lower chamber 55 to raise the upper die member 56, with the fluid in the upper chamber 53 being discharged to a low pressure location.

Let us know review the manner in which the present invention would be used in the method of securing a bundle of logs as described with reference to FIGS. 1–5. As indicated previously, the cable from a long coil of cable is first inserted through one end of the crimping sleeve 64, with the crimping sleeve 64 then being moved a distance down the length of the cable. The free end of the cable is tossed over the top of the bundle of logs and then pulled back under the log bundle, and this free end is inserted through the same opening end that it was originally inserted so that the two cable portions 66 within the sleeve 64 are located side by side and aligned parallel to one another. Then the crimping sleeve is moved through a front opening 82 and a lower housing 40 into an operating region 83 (which includes both the crimping and cutting regions 60 and 62), between the upper and lower die members 56 and 58. To accomplish the crimping operation, the crimping sleeve is located in the crimping region 63.

There is a control device 84 which is shown schematically on the handle 74. The operator moves the control device 74 to cause the upper die member 56 to move downwardly and accomplish the crimping operation. This crimping operation is performed several times along the length of the crimping sleeve 64 (possibly seven or eight times) to properly secure the two cable sections together and thus form the secure cable loop. With this completed, and with the upper die member 56 raised, the apparatus 20 is moved to a location along the cable portion leading back to the coil so as to be about six inches from the adjacent end of the crimping sleeve. Then the apparatus 20 is positioned so that the cable portion that still remains connected to the main coil is located in the cutting region 62, and the control device 84 is again operated to cause the upper die member 56 to descend to cut the cable loop that is around the log bundle free from the remaining cable that extends from the coil of cable.

The control device 84 would have three positions, one to direct the hydraulic fluid into the upper chamber 53 to drive the upper drive member 56 downwardly, a second position to introduce hydraulic fluid into the lower chamber 53 to raise the upper die member 56, and a third neutral position.

To discuss other features of the present invention, with reference to FIG. 8, the apparatus 20 can be considered as having a longitudinal axis 86 extending downwardly through the approximate centerline of the upper housing section 38 and continuing downwardly in a line parallel (or approximately parallel) to the up-and-down travel path of the upper die member 56. In this embodiment the longitudinal axis is coincident with the aforementioned drive axis 54.

With reference to FIGS. 6 and 7, it can be seen that the upper and lower handle members 74 and 76 are elongate members, each of which could be grasped in a person's hands. These two handles 74 and 76 in (or approximately adjacent to) in the same plane, and that plane is aligned (or substantially aligned) with the longitudinal center axis 86. Also shown in FIG. 8 is a lateral operating axis 88 which is perpendicular to the longitudinal axis 86 and extends laterally along the center portion of the operating region 83 toward the access opening 82. It will also be noted that the two crimping surfaces 63 and 72 and the two cutting surface 62 and 68, are positioned so that there is an alignment axis 90 which is parallel to the alignment of the crimping sleeve 64 when it is positioned in the operating region 83, and is perpendicular to both the longitudinal and lateral axes 86 and 88, this axis 90 being indicated at the plus sign in FIG. 9 in the crimping region 60, and being perpendicular to the plane of the paper sheet showing FIG. 8.

Thus, it will be noted that the alignment of the handles 74 and 76, the positioning of the access opening 82, the alignment of the operation region 83, and also the alignment axis 90 for the work piece that is to be crimped or cut are arranged so that the tool 20 can be easily manipulated into position to perform the necessary crimping and/or cutting operation.

It is to be understood that in describing the relative positions of the components of the apparatus 20 for convenience the terms "upper" and "lower" with reference to FIGS. 6–8 is done for convenience of describing the relative positions of the components and the operation. However, in actual use, the apparatus 20 may be oriented so that the longitudinal axis 86 is horizontally aligned so that the alignment axis 90 is vertically oriented.

To comment on yet another feature of the present invention, with reference to FIG. 8, it will be noted that the lower cap 35 and the lower portion of the sidewall 32 are positioned within a surrounding circular flange 92 which is at the upper end of the lower housing portion 36. Also, the piston 42 has a central opening 93 which receives an upper reduced diameter end portion 94 of the drive shaft 48. Then the upper end portion 94 of the drive shaft 48 has a collar 96 connected thereto (e.g. by threads) so that this threaded end portion 94 positions the piston 42 against an upwardly facing annular surface 98 of the main portion of the drive shaft 48. The upper cap 34 is connected to the upper end of the sidewall 76.

It can be seen by looking at the arrangements of the components discussed in the paragraph immediately above, that the entire upper housing section 38 and the actuator 29 can all be assembled as a unit with the drive shaft 48 extending through the lower cap 35 and also through the piston 42, with the end collar 98 being inserted to lock the piston 42 and the drive shaft 48 together. Then the cylindrical sidewall 32 can be positioned in connection with the lower cap 35 and the upper end cap 34 can be attached to the upper end of the cylindrical sidewall 32.

Also, as indicated previously, the three components of the upper housing section 38 (i.e. the sidewall 32 and the two end caps 34 and 35) also function as components of the actuator in that these also form the cylinder of the piston-and-cylinder assembly which comprises the drive assembly 28.

Figure 11:
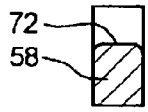
FIG. 11 is a sectional view taken along line 11—11 of FIG. 9, and showing a cross-section of the surface portion of the lower crimping die member.
Figure 11A:
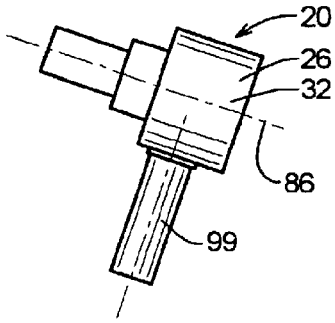
Figure 11B:
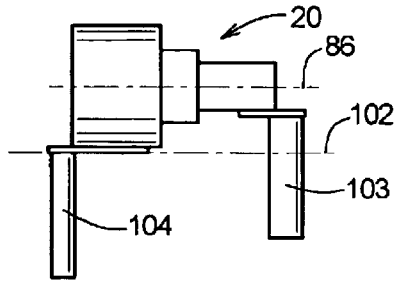

Reference will now be made to FIGS. 11-A and 11-B, which show two modified versions of the handle section of the apparatus 20. FIG. 11-A shows a single handle grip design and FIG. 11-B shows a double handle grip design. In describing these designs in FIGS. 11-A and 11-B, the term "upper" shall refer to a location which is at the top of FIGS. 11-A and 11-B, and the term "lower" shall denote the opposite. The term "forward" shall refer to the location at the left hand of FIGS. 11-A and 11-B, and term "rear" shall denote the opposite.

With reference to FIG. 11-A, as indicated above, there is a single handle grip 99 having an upper end that is connected to the cylindrical sidewall 32 of the housing 26 and extending downwardly therefrom. The overall configuration of this handle grip 99 is that of a "pistol grip". The apparatus 20 remains substantially unchanged in this modified design, except for its attachment to the handle grip 99.

As can be seen in FIG. 11-A, the handle grip 99 in its operating position has its lengthwise axis 100 extending downwardly so that it can be conveniently grasped by the person. The handle grip 99 is arranged so that when the user is grasping the handle grip 99 in a normal fashion of a pistol grip with the fingers of the person's hand extending around the forward side of the handle grip and the forearm horizontal, the longitudinal axis 86 of the apparatus 20 is approximately horizontally aligned, or as shown in FIG. 11-A aligned with a moderate upward and forward slant. This will vary, depending upon the orientation of the sleeve 64 which is to be crimped and the orientation of the cable 66 which is to be cut.

Reference is now made to FIG. 11-B which shows the double handle assembly 102.

In FIG. 11-B, the apparatus 20 is shown in its operating position where the longitudinal axis 86 of the apparatus 20 extends generally horizontally along a horizontal axis indicated at 102.

With the double handle assembly 101 being in its operating position, the "upper end portion" of the apparatus 20 is at a forward location, and the "lower end" of the apparatus 20 is at rear location closer to the user's body.

The handle assembly 101 comprises a rear generally vertically aligned handle grip 103 connected to the lower end portion of the apparatus 20 and a forward vertically aligned handle grip 104 connected to and extended downwardly from the forward portion of the apparatus 20. As in the modified handle version shown in FIG. 11-A, the apparatus 20 remains unchanged in the configuration of FIG. 11-B, except for the mounting of the handle assembly 101.

Also, it can be seen that each lengthwise axis of the two grips 103 and 104 are vertically oriented and lie generally in the same vertically aligned plane. A forward to rear alignment axis extends through the two hand grips 103 and 104 generally in a forward to rear direction, having a substantial alignment component parallel to the longitudinal axis 86 of the apparatus 20. Thus, as it can be seen in FIG. 11-B, with the apparatus 20 in its operating position with its longitudinal axis 86 generally horizontal, the apparatus 20 is in an operating position.

It is to be understood that in FIGS. 11-A and 11-B, the apparatus 20 is shown in a operating position which would be used when the crimping sleeve 64 is generally vertically aligned and the cable 66 which is to be cut is also generally vertically aligned. The vertical alignment of the crimping sleeve 64 and the cable 66 would generally occur when performing the log bundling operation of FIGS. 1–5. Also, it is be understood that the apparatus 20 could be used in various positions and orientations. Also, it is to be understood that for some applications the alignment of the crimping sleeve and the cable to be cut extend more horizontally, the apparatus 20 in its present configuration could be used to perform such crimping and cutting operations. However, within the broader scope of the present invention, the arrangement of the handle or handles could be modified to make the positioning of the apparatus 20 more convenient for these other orientations.

Figure 12:
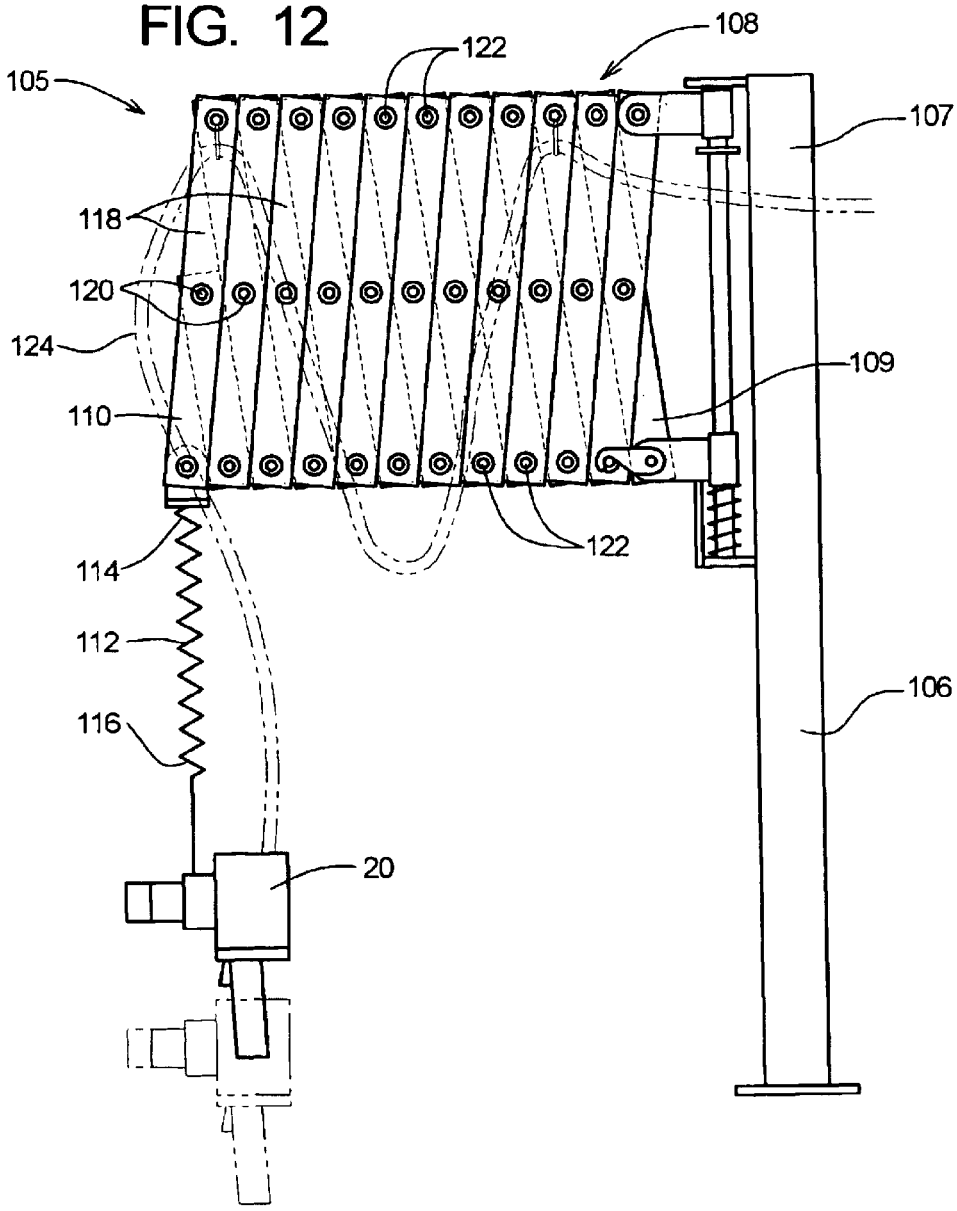
FIG. 12 is a side elevational view of the extendable/retractable mounting system for the apparatus of the present invention, this being shown in its retracted.
Figure 13:
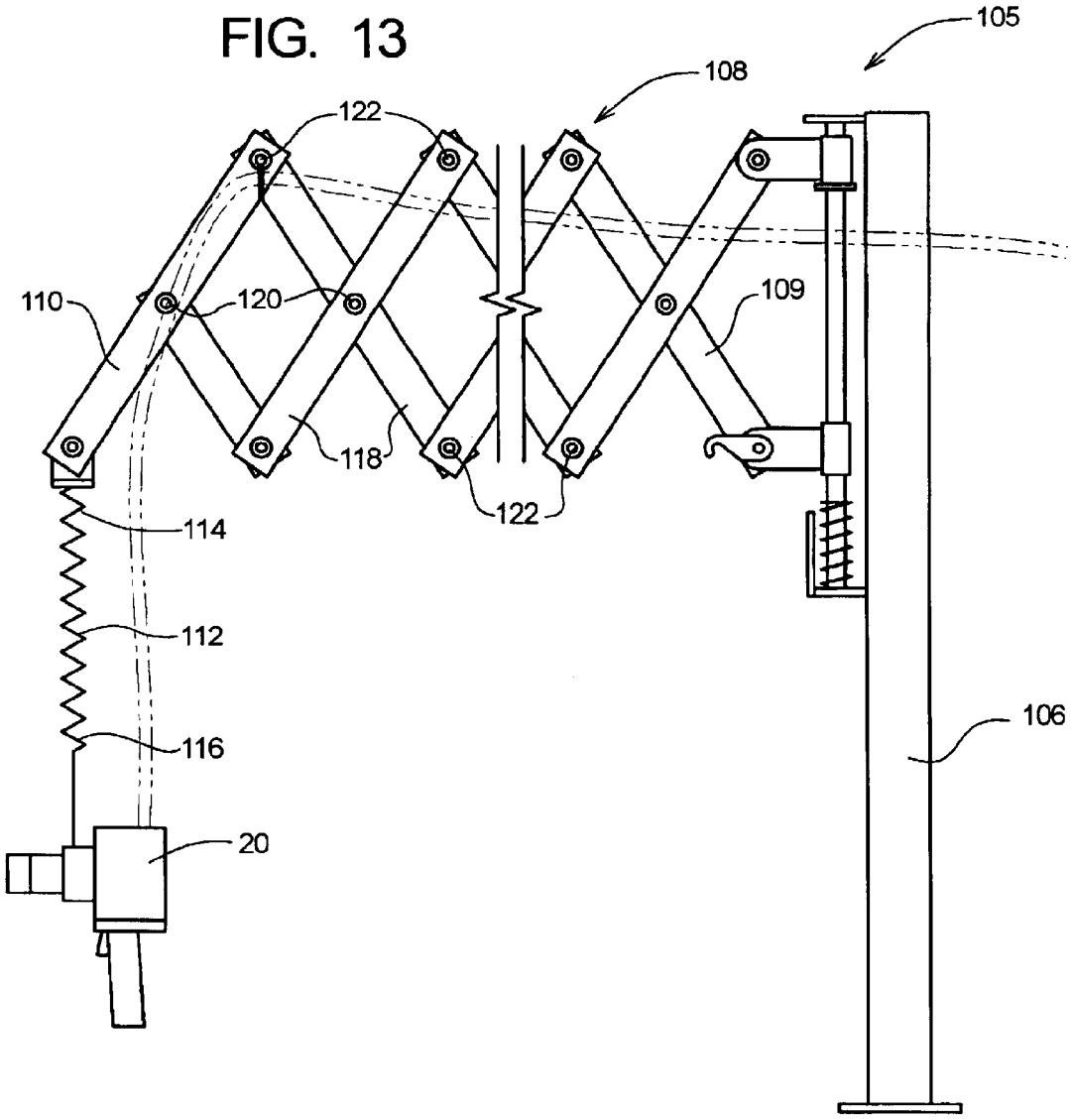
FIG. 13 is a side elevational view similar to FIG. 11, but showing the mounting system in its extended position.

Reference is now made to FIGS. 12 and 13 which show an extendable and retractable mounting apparatus 105 for the apparatus 20 of the present invention. This mounting apparatus 105 would be particularly helpful in the working environment such as shown in FIGS. 1–5.

This mounting apparatus 105 comprises a vertical post 106 which is firmly mounted at a lower end base location. Connected to the upper end portion 107 of the post 106 is an extendable/retractable lateral support section 108, having an inner end 109 connecting to the upper part 107 of the post 106, and an outer end 110. At the outer end of the lateral support section 108, there is a support spring 112, the upper end 114 of which connects to an outer lower portion of the support section 106, and a lower end 116 of which is attached to the crimping/cutting apparatus 20. The length and resistance to extension of the support spring 112 is such that when the support spring 112 is supporting only the apparatus 20, the apparatus 20 remains at a convenient location for easy access by the user.

The extendable/retractable lateral section 108 is in the form of a scissors linkage, comprising a plurality of support struts 118 which, in a conventional prior art manner, are connected at center pivot locations 120 and end pivot locations 122. In FIG. 12, the mounting assembly 120 is shown in a retracted position, and in FIG. 13 it is shown in its extended position.

Thus, the person operating the apparatus 20 is able to move freely with the crimping/cutting apparatus 20 to various locations and also to maneuver the crimping/cutting apparatus 20 to various orientations and positions. Then when the apparatus is not in immediate use, the operator simply releases the apparatus 20 and it still remains in a convenient location. Also, the apparatus can easily be moved back to an "out-of-the-way" location.

It will be noted in FIG. 13 that the hydraulic line or lines 124 are arranged so that these can be connected at an outer end portion of the extendable/retractable lateral mounting member 106, and these hydraulic lines can be mounted to a spring-loaded retractable reel so that as the mounting member 106 is retracted, the lines 124 will also retract.

Reference is now made to FIGS. 14–23, which show the components of the present invention in more detail.

Figure 14:
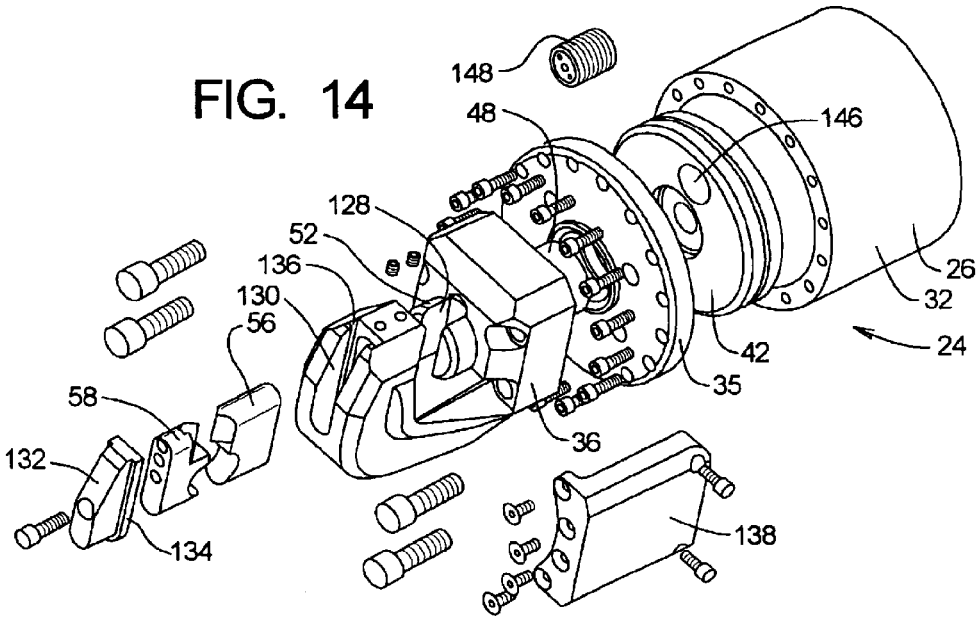
FIG. 14 is an exploded isometric view of the apparatus of the present invention.

With reference first to the exploded view of FIG. 14, numerical designations will be placed in this FIG. 14 to indicate some of the main components, and since these are discussed earlier in this text and are readily identifiable by the numerical designations given in FIG. 14, a detailed explanation will not be given except possibly for pointing out certain additional design features not previously disclosed.

In FIG. 14, there is the cylindrical sidewall 32 of the housing section 26, the piston 42, the lower cap 35 and the base section 36 of the housing 26. The lower end portion 52 of the drive shaft 48 is shown, and it can be seen that it is formed with a recess 128 to receive the upper die member 56.

In like manner, the lower part of the base section 36 of the housing 26 is formed with a recess 130 to receive the lower stationary die member 58. It will noted that there is in addition a retaining member 132 for the lower die member 58, and this retaining member 132 has a pair of laterally extending edge portions 134 to fit in matching slots 136 in the recess 130.

There is a side mounting plate 138 which bolts onto the sidewall 32 of the housing 46 to connect to the handle member 99 shown in FIG. 11-A.

Figure 15:
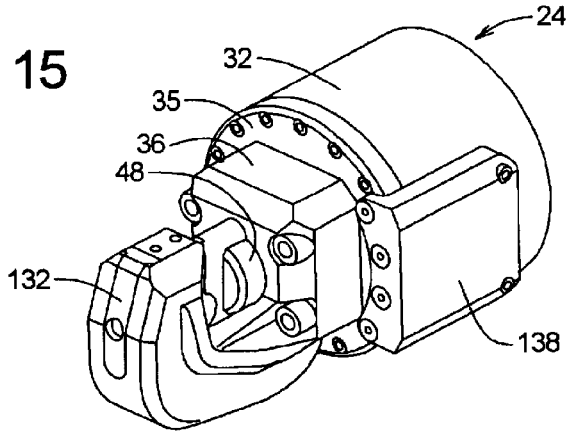
FIG. 15 is an isometric view similar to FIG. 14, but showing the components assembled into the operating apparatus.

In FIG. 15, the components shown in FIG. 14 are illustrated in their assembled configuration.

Figure 16:
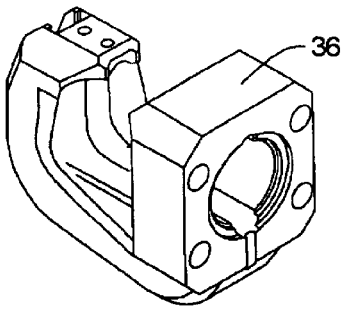
FIGS. 16 and 17 are isometric views taken from different viewing locations, showing the lower base section of the housing of the present invention.
Figure 17:
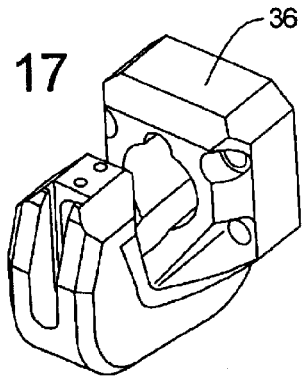

FIGS. 16 and 17 are two isometric views taken from different view locations of the base section 36 of the apparatus 20.

Figure 18:
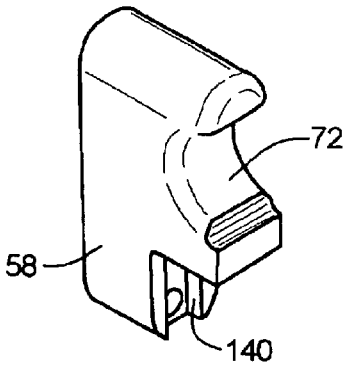
FIG. 18 is an isometric view of the lower stationary die member.

FIG. 18 shows the lower die member 58 having the crimping surface 72. It can be seen that at the location of the cutter of the lower die member 58 there is a receiving slot 140 which receives the removable/replaceable cutter blade 144.

Figure 19:
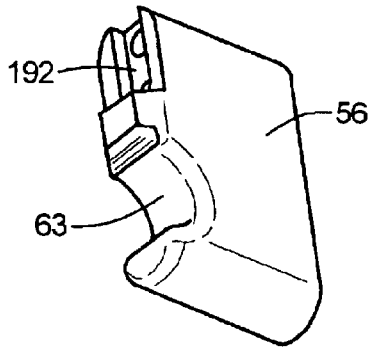
FIG. 19 is an isometric view of the upper movable die member.

FIG. 19 shows the upper movable die member 56, with its crimping surface 63. It will be noted that it also has a recess 142 to receive the cutter blade 144.

Figure 20:
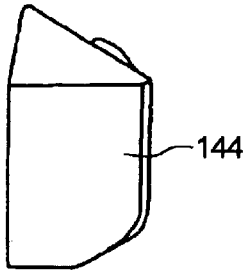
FIGS. 20 and 21 are two isometric views of one of the cutter blades.
Figure 21:
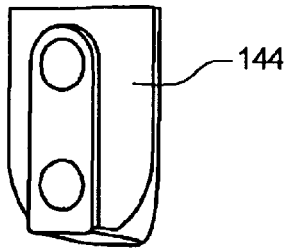

FIGS. 20 and 21 are two views of a removable cutter blade 144. These can be fastened in-place in their respective die members 56 or 58 by conventional means, such as by bolts which could be extending into the recess area to threadedly engage the cutter blade 144.

Figure 22:
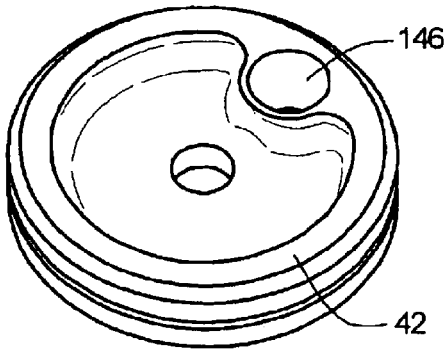
FIG. 22 is an isometric view of the drive piston.
Figure 23:
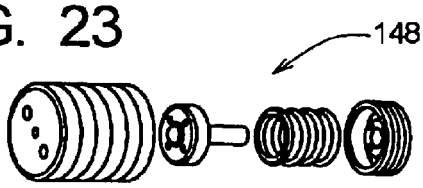
FIG. 23 is an isometric exploded view of the relief valve which is positioned in the cylinder of FIG. 23.

In FIG. 22, there is an isometric view of the piston 42. It will noted that the piston 42 is formed with a through opening 146 near its perimeter, and this is to receive a relief valve 148 which is shown in an exploded view in FIG. 22. Thus, if the resistance to the crimping and/or cutting force reaches a threshold level, then the pressure relief valve 148 would permit the high pressure hydraulic fluid to flow therethrough to maintain the pressure level and exerted force at a desired and designed level.

The invention is susceptible to various modifications and alternative forms, specific embodiments thereof have been shown by way of example in the drawings and are described in detail. However, it should be understood, that it is not intended to limit the invention to the particular forms disclosed, but, on the contrary, the intention is to cover all modifications, equivalents, and alternatives falling within the spirit and scope of the invention as expressed in the appended claims.

What is claimed is:

1. A crimping and cutting apparatus having a longitudinal axis and a lateral axis an upper end and a lower end, said apparatus being for crimping elongated member having a material longitudinal axis, and comprising:

a) a housing section with a cylinder and piston assembly aligned with the longitudinal axis and having a longitudinally aligned drive member connected to, and extending outwardly from the piston for up and down movement parallel to said longitudinal axis;

b) a die assembly located at a lower location relative to said cylinder and piston assembly and having an operating region which comprises crimping and cutting regions, and comprising:

i. a first die member mounted to said housing above said operating region for up and down linear travel and comprising a first downwardly facing crimping surface at said crimping region and a first downwardly facing cutting surface at said cutting region, said first crimping surface and said first cutting surface being spaced laterally from one another in a direction generally along said lateral axis, said first die member being connected to a lower end portion of said cylinder and piston assembly member to cause the first die member to move linearly in upwardly and downward directions parallel to the longitudinal axis;

ii. a second die member located in said housing at a stationary location below the operating region fixedly mounted to the housing section and comprising a second upwardly facing crimping surface at said crimping region, and second upwardly facing cutting surface at said cutting region, c) said first and second crimping surfaces, and said first and second cutting surfaces being positioned opposite one another and located so that as the cylinder and piston assembly moves the first die member toward the operating region, the first and second crimping surfaces come into a crimping position relative to one another to be able to perform a crimping operation, and the first and second cutting surfaces come into a cutting position relative to one another to be able to perform a cutting operation, said second crimping surface and said second cutting surface being spaced laterally from one another in a direction generally parallel to the lateral axis and positioned so as to be aligned with, respectively, the first crimping surface and the first cutting surface, with the die members, housing and cylinder and piston assembly being arranged to constrain the up and down movement of the first die member parallel to said longitudinal axis to maintain the first and second crimping surface in longitudinal alignment with one another and the first and second cutting surfaces in longitudinal alignment with one another;

d) said apparatus being arranged with an operating access opening connecting to said operating region, whereby a member to be crimped and/or cut is able to be moved along the lateral axis with the member longitudinal axis extending transverse to both the longitudinal axis and the lateral axis through said access opening into the operating region to either the crimping region or the cutting region to be crimped or cut, respectively, and can be both crimped and cut in separate crimping and cutting operations while remaining in said operating region.

2. The apparatus as recited in claim 1, wherein said housing section comprises an upper housing portion and a lower housing portion aligned with one another along said longitudinal axis, said housing section comprising an outer cylindrical vertically aligned sidewall in the cylinder and piston assembly that functions as said cylinder and having upper and lower cap portions, said upper cap portion defining with said cylinder and said piston an upper chamber, and said lower cap portion defining with said cylinder and piston a lower chamber, said drive member being constrained to move parallel to said longitudinal axis.

3. The apparatus as recited in claim 2, wherein said first and second die members are positioned in said lower housing portion, and there is a guide structure comprising right and left guide portions engaging right and left portions of the upper die member for linear movement back and forth in said guide portions.

4. The apparatus as recited in claim 1, wherein said crimping region and said cutting region are open to one another so that a member or portions of a member to be crimped and cut can be moved between said crimping and cutting regions without being removed from said operating region.

5. The apparatus as recited in claim 4, wherein said access opening is spaced laterally from said operating region so that a member to be crimped and/or cut can be moved laterally into said operating region and selectively to either or both of said crimping and cutting regions.

6. The apparatus as recited in claim 5, wherein said access opening is laterally aligned with said operating region.

7. The apparatus as recited in claim 1, wherein said second die member is removably located in said lower housing section, whereby said second die member can be removed and/or replaced.

8. The apparatus as recited in claim 1, wherein said apparatus comprises a positioning section which in turn comprises a handle which may be manually grasped, said handle having a first connecting portion connected to said housing and extending generally laterally from said longitudinal axis.

9. The apparatus as recited in claim 1, wherein there is a positioning section which comprises two handles, one of which is adjacent to the upper housing portion, and the other which is adjacent to the lower housing portion, with each of said handles being adapted to be manually grasped.

* * * * *